US007314263B2

(12) United States Patent
Hayasaki et al.

(10) Patent No.: US 7,314,263 B2
(45) Date of Patent: Jan. 1, 2008

(54) PRINTING APPARATUS, INKJET PRINTHEAD, AND CARTRIDGE TYPE DISCRIMINATION METHOD

(75) Inventors: Kimiyuki Hayasaki, Kanagawa-ken (JP); Takahiro Matsui, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 383 days.

(21) Appl. No.: 11/094,164

(22) Filed: Mar. 31, 2005

(65) Prior Publication Data

US 2005/0219336 A1 Oct. 6, 2005

(30) Foreign Application Priority Data

Mar. 31, 2004 (JP) ..... 2004-106352

(51) Int. Cl.
*B41J 29/393* (2006.01)

(52) U.S. Cl. ..... 347/19

(58) Field of Classification Search ..... 347/5, 347/7, 19, 49, 85, 87
See application file for complete search history.

(56) References Cited

U.S. PATENT DOCUMENTS 6,196,670 B1 * 3/2001 Saruta ..... 347/86
6,533,383 B1 * 3/2003 Saruta et al. ..... 347/19
6,820,955 B1 * 11/2004 Usui ..... 347/7
7,130,065 B2 * 10/2006 Kohno ..... 358/1.13
7,134,738 B2 * 11/2006 Saruta ..... 347/19
7,136,831 B2 * 11/2006 Mori et al. ..... 705/28

FOREIGN PATENT DOCUMENTS

| | | |
|---|---|---|
| JP | 3-67657 | 3/1991 |
| JP | 5-8383 | 1/1993 |
| JP | 2001-63058 | 3/2001 |

* cited by examiner

*Primary Examiner*—Anh T. N. Vo
(74) *Attorney, Agent, or Firm*—Fitzpatrick, Cella, Harper & Scinto

(57) ABSTRACT

This invention relates to a printing apparatus, printhead, and cartridge type discrimination method capable of achieving high-reliability, high-quality printing by effectively utilizing a memory element incorporated in the printing apparatus and dealing with an error by all the building components of the printing apparatus. According to this invention, in a printing apparatus which prints on a printing medium with an ink cartridge and inkjet printhead mounted on a carriage, mounting of the ink cartridge on the carriage is detected, identification information is read from the non-volatile memory of the ink cartridge, and it is discriminated on the basis of the identification information whether or not the mounted cartridge is a certified one for the printing apparatus.

1 Claim, 7 Drawing Sheets

PRINTING APPARATUS, INKJET PRINTHEAD, AND CARTRIDGE TYPE DISCRIMINATION METHOD

FIELD OF THE INVENTION

This invention relates to a printing apparatus, inkjet printhead, and cartridge type discrimination method and, more particularly, to an inkjet printhead which print upon receiving ink from a cartridge serving as an exchangeable member, printing apparatus and a cartridge type discrimination method.

BACKGROUND OF THE INVENTION

Printing apparatuses which print information such as a desired character or image on a printing medium such as paper are widely used as an information output apparatus for a personal computer, facsimile apparatus, and the like. These printing apparatuses are used as printers in modern business offices, in other business affairs departments, and for personal use. The printing apparatuses have been developed and improved for achieving further cost reduction and higher resolution while strongly requiring not only higher resolution but also higher-speed printing.

Of these printing apparatuses, an inkjet printing apparatus which prints by discharging ink from orifices arranged on printing elements utilized for quiet non-impact printing can attain high resolution and high-speed printing due to its structural feature, and is widely spread as a low-cost color printer or the like. The inkjet printing apparatus prints by discharging ink in accordance with desired printing information by using a printhead having a printing element with an orifice and an electrothermal transducer which generates discharge energy for discharging ink from the orifice.

It is conventionally known that the inkjet printhead has an arrangement in which a plurality of printing elements are aligned in one or a plurality of arrays. As an arrangement using such an inkjet printhead, a plurality of inkjet printheads are mounted on a carriage in accordance with the types of ink, or a plurality of ink cartridges are mounted on a single inkjet printhead. An inkjet printhead and ink cartridge are integrated in the former arrangement, and are separable in the latter arrangement.

As the resolution and image quality have been required in recent printing, the performance of the inkjet printhead has greatly improved. In particular, the throughput has increased by increasing the number of integrated printing elements or the number of concurrently drivable printing elements.

Along with this, the function of the ink cartridge has also been advanced. Ink itself is required to have a carefully prepared component and composition ratio in order to satisfy printing performance. For example, a pigment has replaced a dye which has conventionally been adopted as a coloring material, in order to enhance weather resistance. Inks of respective colors react with each other in multicolor printing, and a resin component for promoting fixing is added for high-speed printing.

When ink whose component and composition ratio change with the improvement of printing performance is employed, the printing apparatus functions without any problem and ink performance can be fully exerted as far as ink is simply used in the printing apparatus. However, when a plurality of types of inks are mixedly used, for example, different types of inks are alternately used in the same printing apparatus, the different types of inks mix with each other, and ink may coagulate within the printhead or adhere to the ink discharge surface of the printhead.

In some cases, in order to prevent mixing of different types of inks in the same printhead, an ink cartridge incompatible in shape with other ink cartridges must be newly prepared.

However, if ink cartridges (ink tanks) incompatible in shape are introduced to many printer models, ink cartridges of new shapes appear on the market as new printers are released one after another. As a result, the customer is confused in selecting the type of ink cartridge suitable to his printer, or a suitable ink cartridge may not be available to the customer due to an insufficient space of the stockroom of the shop when he needs it.

As an approach which solves this problem, there have been proposed an inkjet printing apparatus and ink cartridge, which incorporates a memory element which stores pieces of information such as the type of ink and remaining ink amount in the ink cartridge and the expiry date. A printing apparatus main body to which the ink cartridge is mounted detects these pieces of information from the memory element, and starts operation. For example, Japanese Patent Laid-Open No. 3-67657 discloses an arrangement in which a medium that stores information on driving of an inkjet head is arranged on an ink cartridge that contains ink so as to drive the printhead under driving conditions complying with the ink composition.

Pieces of information on ink make it possible to use under optimal conditions an inkjet printing apparatus to which an ink cartridge is mounted, an inkjet printhead which actually discharges ink, and ink contained in the ink cartridge, and are stored in the memory element of the ink cartridge.

As an arrangement which controls a printing apparatus main body in correspondence with a mounted printhead, for example, Japanese Patent Laid-Open No. 5-8383 discloses an arrangement in which the type of mounted printhead is detected and printing control corresponding to the type of printhead is performed.

There has also conventionally been known an arrangement in which printhead information is read from a memory means arranged in the printhead and the printing apparatus main body is controlled on the basis of characteristic information such as the discharge amount (e.g., Japanese Patent Laid-Open No. 2001-63058).

In the conventional inkjet printing apparatuses, an exchangeable inkjet printhead and ink cartridge are convenient, but at the same time may cause various system errors.

Most of the causes of such errors result from the difference in ink composition. This may physically degrade the functions of not only the ink cartridge but also the inkjet printhead and inkjet printing apparatus. Of various system errors, clogging of the inkjet printhead is especially fatal. This is because clogging is directly linked with a printing failure and degradation of the printing quality, and exchange of a purchased inkjet printhead due to clogging impairs customer's reliability of the product. Hence, demands arise for a product which can avoid any error in advance in order to provide a high-reliability inkjet printing apparatus even if clogging is caused by the customer who intentionally or unintentionally mixedly uses ink cartridges different in ink composition.

SUMMARY OF THE INVENTION

Accordingly, the present invention is conceived as a response to the above-described disadvantages of the conventional art.

For example, a printing apparatus, printhead and cartridge type discrimination method according to the present invention are capable of achieving high-reliability, high-quality printing by effectively utilizing a memory element incorporated in the printing apparatus and dealing with an error by all the building components of the printing apparatus.

According to one aspect of the present invention, preferably, there is provided a printing apparatus in which a cartridge that contains liquid used for printing and has a non-volatile memory storing identification information of the cartridge can be mounted, and ink supplied from the cartridge is discharged to print, comprising: an inkjet printhead having a contact at which an electrical connection with the non-volatile memory is established to read the identification information from the non-volatile memory of the mounted cartridge; detection means for detecting mounting of the cartridge; discrimination means for discriminating, on the basis of the identification information read from the non-volatile memory of the cartridge, whether or not the mounted cartridge is a certified one for the printing apparatus; and recovery control means for controlling to perform recovery operation of the inkjet printhead in a case where it is discriminated by the discrimination means that the mounted cartridge is not a certified one.

According to another aspect of the present invention, preferably, there is provided an inkjet printhead used to discharge ink supplied from a cartridge in a printing apparatus in which the cartridge that contains liquid used for printing and has a non-volatile memory storing identification information of the cartridge can be mounted, comprising an electric contact for establishing an electrical connection with the non-volatile memory in order to read the identification information from the non-volatile memory when the cartridge is connected.

The printhead preferably further comprises a second non-volatile memory which stores information. The printhead desirably accepts a plurality of ink cartridges which contain inks of different colors.

According to still another aspect of the present invention, preferably, there is provided a printing apparatus which prints on a printing medium by using the above-described inkjet printhead, comprising: detection means for detecting mounting of a cartridge; and discrimination means for discriminating, on the basis of the identification information read from the non-volatile memory of the cartridge, whether or not the mounted cartridge is a certified one for the printing apparatus.

The printing apparatus desirably further comprises a carriage, to which the cartridge and the inkjet printhead are mounted, which reciprocates, and the carriage desirably has a third non-volatile memory which stores information.

The printing apparatus desirably further comprises control means for performing printing operation by the inkjet printhead, the control means is desirably mounted on a control circuit board, and the control circuit board desirably has a fourth non-volatile memory which stores information.

In this arrangement, exchange history information of the cartridge is preferably stored in the second, third, or fourth non-volatile memory.

When an electrical connection with the mounted cartridge is not established at a contact of the inkjet printhead, the discrimination means discriminates that a cartridge which is not a certified one has been mounted. When it is discriminated by the discrimination means that the mounted cartridge is not a certified one, recovery operation of the inkjet printhead is desirably controlled to be performed. In this case, the printing apparatus preferably further transmits message information to a host apparatus so as to display a message for prompting a user to exchange the cartridge with a certified one, or further comprises display means (e.g., LCD) for displaying a message for prompting a user to exchange the cartridge with a certified one.

According to still another aspect of the present invention, preferably, there is provided a cartridge type discrimination method in a printing apparatus which prints on a printing medium by using the above described inkjet printhead, comprising: a detection step of detecting mounting of a cartridge on a carriage, to which the cartridge and the inkjet printhead are mounted, which reciprocates; and a discrimination step of discriminating, on the basis of identification information read from a non-volatile memory of the cartridge, whether or not the mounted cartridge is a certified one for the printing apparatus.

The invention is particularly advantageous since, for example, when a cartridge containing ink whose composition is different from a certified one is mounted, ink entering the printing apparatus is discharged outside the apparatus as quick as possible, and the user is notified of this to prompt mounting of a certified cartridge so as to maintain the printing apparatus and printhead in good conditions. As a result, a high-reliability printing apparatus can be implemented.

In addition, a plurality of non-volatile memories are arranged on, e.g., the printhead, the cartridge, the carriage, and the control circuit board of the printing apparatus, and at least one of these memories hold exchange history information of the cartridge. For example, when a cartridge different from a certified one is mounted or an error occurs, the user can be periodically notified of these pieces of information, and proper usage of the printing apparatus and a change in printing state can be reported.

The present invention is not limited to a printing apparatus for personal use, but can also be applied to a high-end printing apparatus for office use or a printing apparatus which adopts a full-line printhead with a printing width corresponding to the width of a printing sheet and uses an exchangeable cartridge.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENT

A preferred embodiment of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium (or printing medium)" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "nozzle" generally means a set of a discharge orifice, a liquid channel connected to the orifice and an element to generate energy utilized for ink discharge.

<Description of Inkjet Printing Apparatus (FIG. 1)>

Figure 1:
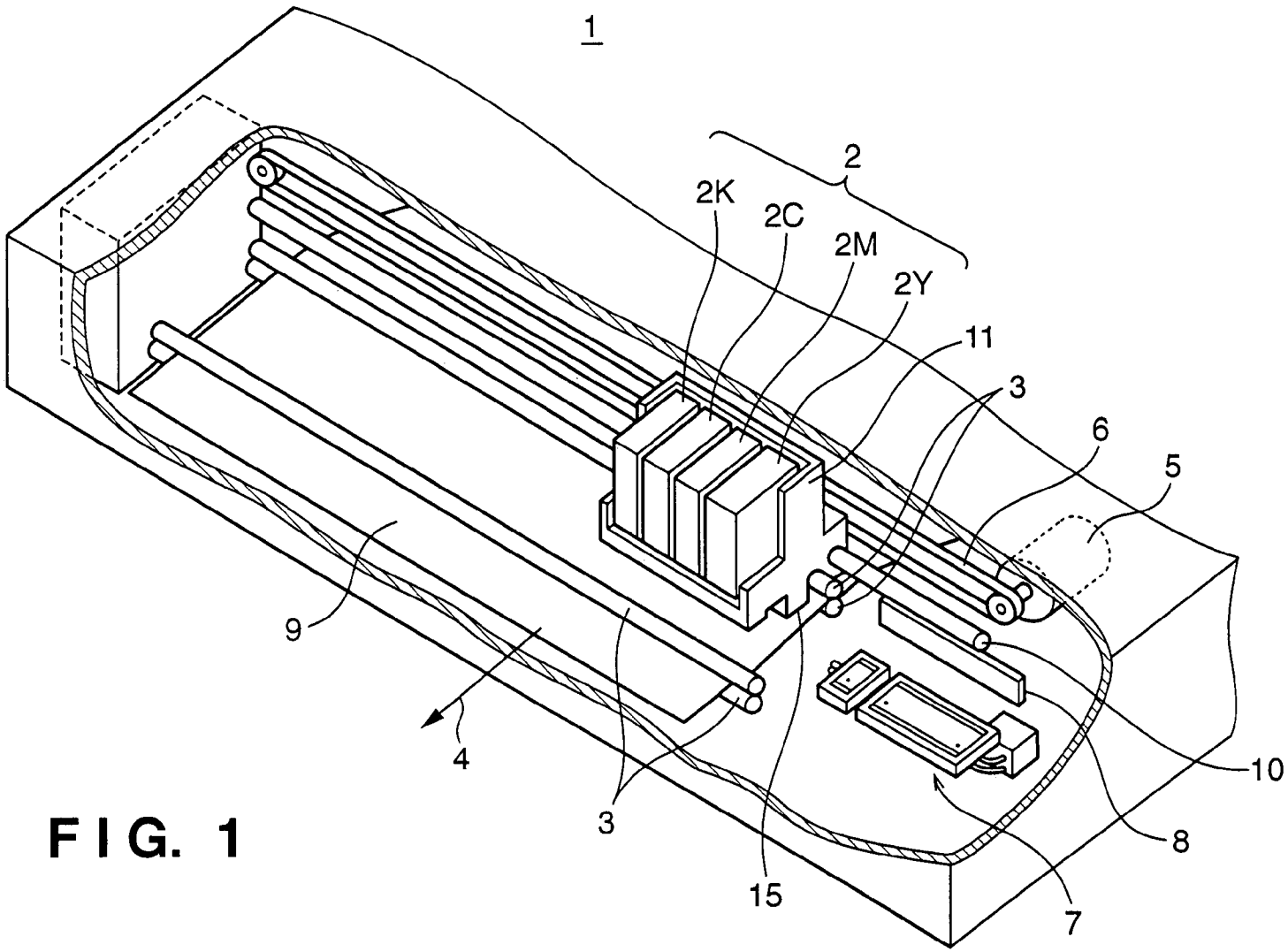
FIG. 1 is an outer perspective view showing the schematic arrangement of an inkjet printing apparatus 1 according to a typical embodiment of the present invention.

FIG. 1 is an outer perspective view showing the schematic arrangement of an inkjet printing apparatus 1 (hereinafter referred to as a printing apparatus) according to a typical embodiment of the present invention.

In FIG. 1, a printhead 15 reciprocates by a driving belt 6 which transmits the driving force of a carriage motor 5. The printhead 15 is connected to an ink cartridge 2. The printhead 15 is recovered by a suction recovery pump 7 and wiper blade 8. In the printing apparatus 1, control of a unique recovery operation sequence can be changed on the basis of memory element information (to be described later).

The ink cartridge 2 includes four types of ink cartridges in accordance with the types of inks stored in them although their structures are the same. These ink cartridges are an ink cartridge 2K which contains black ink, an ink cartridge 2C which contains cyan ink, an ink cartridge 2M which contains magenta ink, and an ink cartridge 2Y which contains yellow ink. The four ink cartridges are individually exchangeable. As is apparent from FIG. 1, these ink cartridges are generally referred to by reference numeral "2".

In printing operation, a carriage 11 to which the printhead 15 and ink cartridge 2 are mounted reciprocates along a guide bar. In synchronism with this movement, a printing medium 9 is conveyed by conveyance rollers 3 in a direction indicated by an arrow 4.

The printing apparatus 1 prints by transferring a printing image from a host apparatus (not shown) such as a personal computer (PC), image scanner, or digital camera. In this case, the user can be notified of a proper process based on memory information of the building components of the printing apparatus by using a user interface controlled by a printer driver. A stand-alone type printing apparatus capable of completing printing operation by only the printing apparatus can notify the user of information by using, e.g., a small-size LCD provided to the printing apparatus. These information transmission methods can be arbitrarily selected.

Figure 2A:
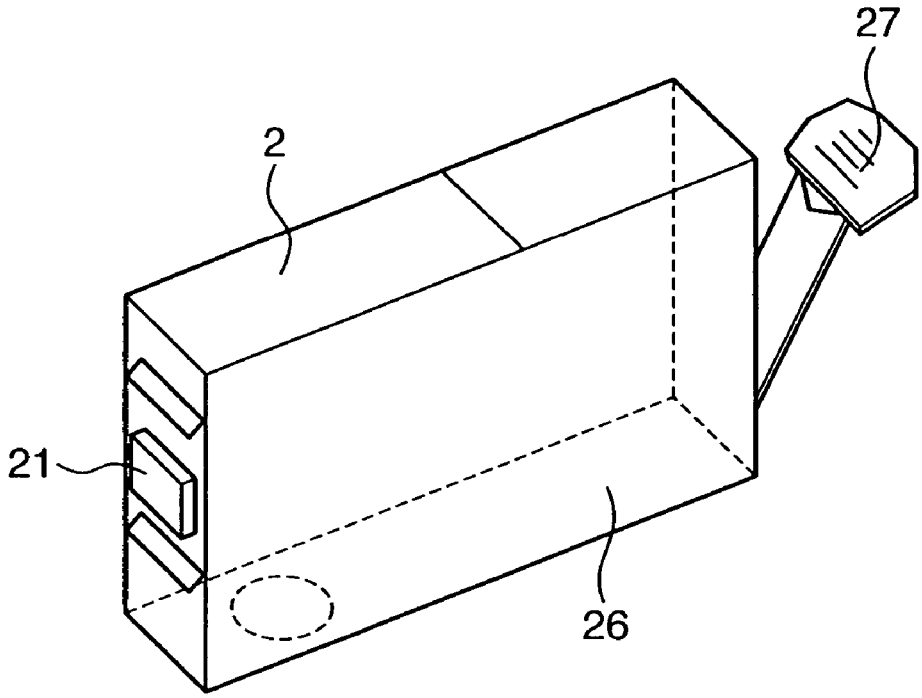
FIGS. 2A and 2B are outer views showing an ink cartridge.
Figure 2B:
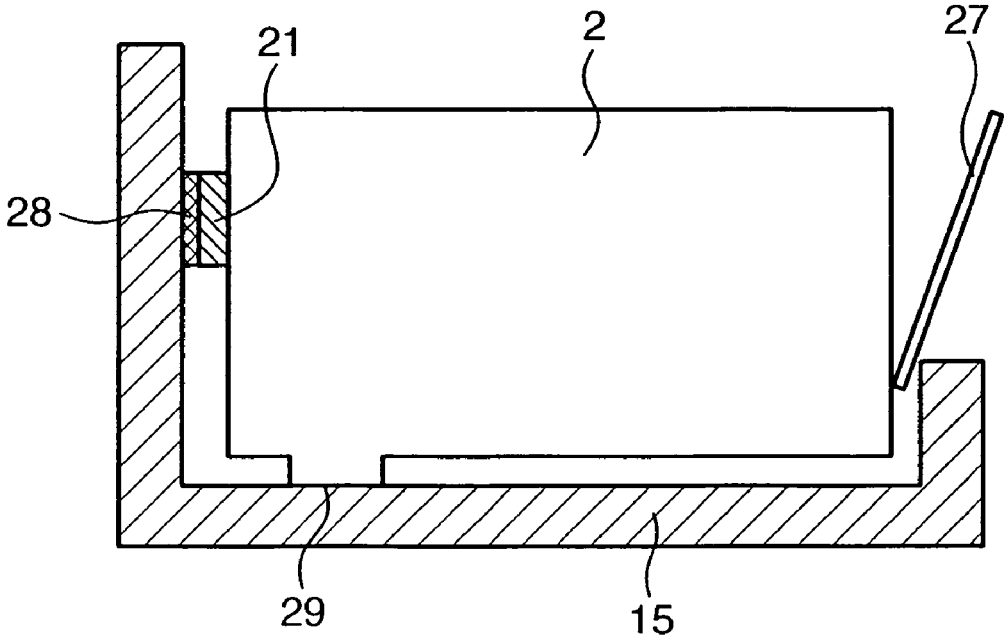

FIGS. 2A and 2B are outer views showing the ink cartridge.

FIG. 2A is an outer perspective view showing the whole structure of the ink cartridge. FIG. 2B is a sectional side view showing the ink cartridge mounted in the printhead 15.

As shown in FIG. 2A, the ink cartridge 2 is substantially constituted by an ink container 26, a latch layer 27 used to attach the ink cartridge 2 to the printing apparatus, and a memory element 21 which stores various pieces of information. The memory element 21 is a non-volatile memory which saves information even upon power-off, and is an electrically programmable EEPROM, FeRAM, MRAM, or the like.

As shown in FIG. 2B, when the ink cartridge 2 is mounted in the printhead 15, the memory element 21 is electrically connected to a contact 28 formed on the printhead 15. The ink cartridge 2 and printhead 15 press-contact with each other at a joint 29, and ink is supplied from the ink cartridge 2 to the printhead 15 via the joint.

If an uncertified ink cartridge, e.g., an ink cartridge having no memory element or an ink cartridge not equipped with a memory element at a proper position is mounted in the printhead 15, electrical connection is not established at the contact 28, and the contact 28 is left open. The printing apparatus main body is notified of this state from the printhead 15 via the carriage 11.

In addition, when any ink cartridge is mounted in the printhead regardless of whether or not the ink cartridge is certified, or the printhead is mounted on the carriage without mounting any ink cartridge, the carriage moves to the home position to detect whether or not the ink cartridge has been mounted. Whether or not the ink cartridge has been mounted can be determined by irradiating the bottom of the carriage with light from an optical sensor attached near the home position and detecting the reflected light. This technique is well known, and a further description thereof will be omitted.

Figure 3:
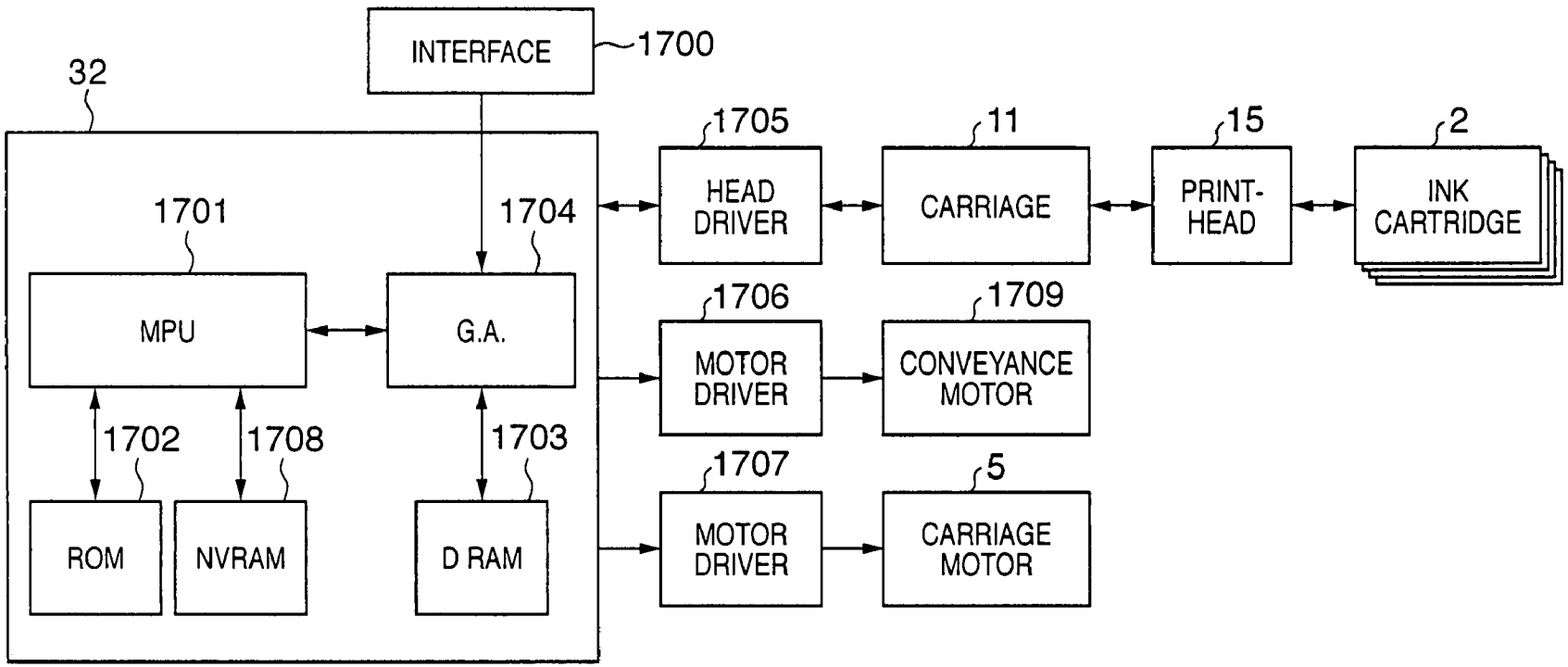
FIG. 3 is a block diagram showing the control configuration of the printing apparatus shown in FIG. 1.

FIG. 3 is a block diagram showing the configuration of the control circuit of the printing apparatus.

In FIG. 3 showing the control circuit, reference numeral 1700 denotes an interface which inputs printing data from a host apparatus (not shown); 1701, an MPU; 1702, a ROM which stores a control program to be executed by the MPU 1701; 1703, a DRAM which saves various data (the above-described printing data, a printing signal supplied to the printhead 15, and the like); 1704, a gate array (G.A.) which supplies and controls a printing signal to the printhead 15, and also controls data transfer between the interface 1700, the MPU 1701, and the DRAM 1703; and 1708, an electrically programmable non-volatile memory (NVRAM) such as an EEPROM, FeRAM, or MRAM. These building components are integrated on a control circuit board 32.

The carriage motor 5 reciprocates the carriage 11 to which the printhead 15 and ink cartridge 2 are mounted. Reference numeral 1709 denotes a conveyance motor which conveys a printing sheet; 1705, a head driver which drives the printhead 15; 1706 and 1707, motor drivers which drive the conveyance motor 1709 and the carriage motor 5, respectively.

The operation of the above control configuration will be explained. When printing data is input to the interface 1700, the printing data is converted into a printing signal used for print between the gate array 1704 and the MPU 1701. The motor drivers 1706 and 1707 are driven, and at the same time the printhead 15 is driven in accordance with the printing signal supplied to the head driver 1705, thereby printing.

A process of confirming in the printing apparatus having the above arrangement whether or not an ink cartridge suitable to the apparatus has been mounted will be explained.

Figure 4:
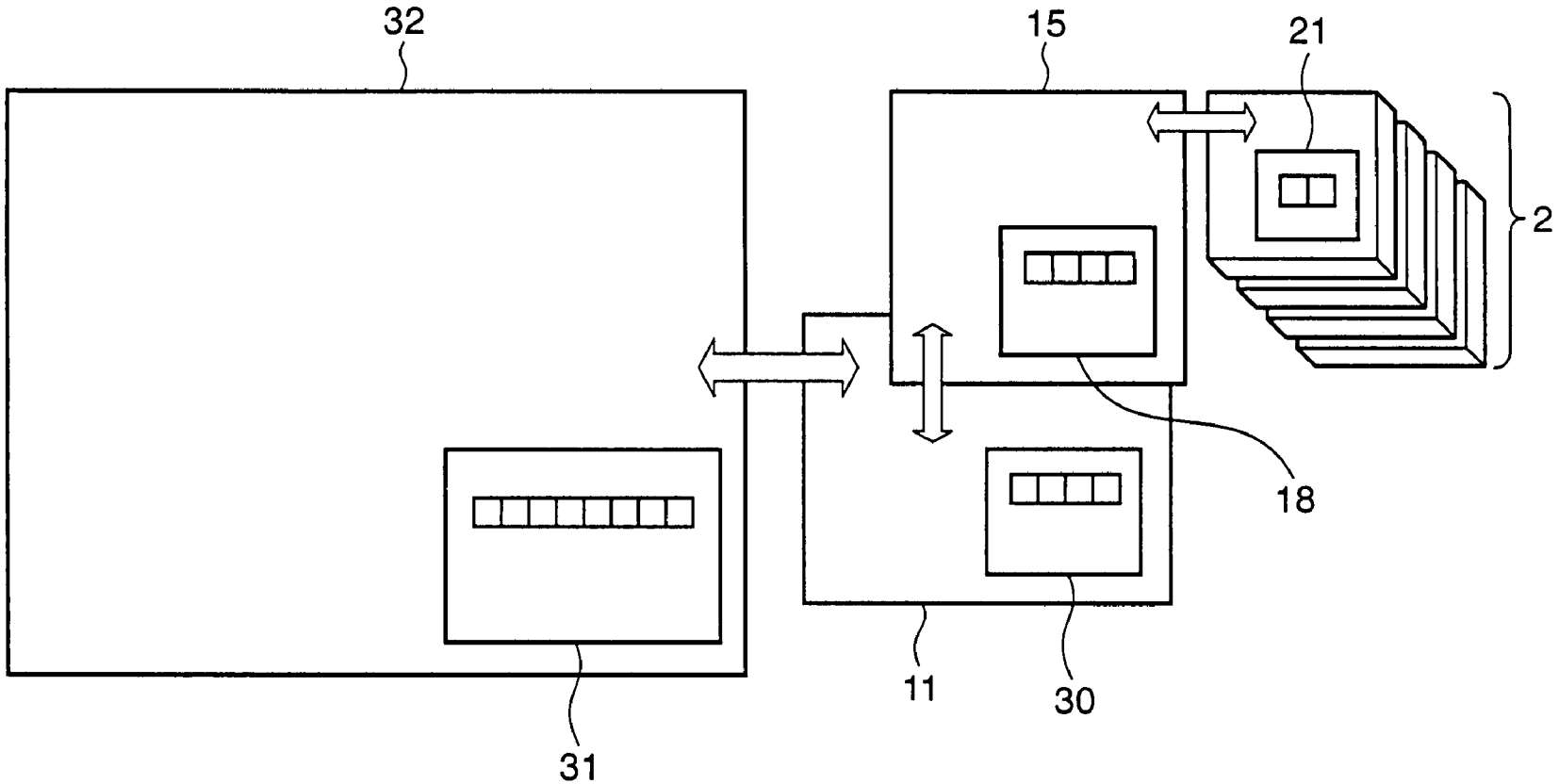
FIG. 4 is a functional block diagram showing the relationship between the ink cartridge, a printhead, a carriage, and a control circuit board.

FIG. 4 is a functional block diagram showing the relationship between the ink cartridge, the printhead, the carriage, and the control circuit board according to this embodiment.

As shown in FIG. 4, a memory element 18 is arranged as a non-volatile memory such as an EEPROM, FeRAM, or MRAM on the printhead 15. The NVRAM 1708 is also arranged as a memory element 31 on the control circuit board 32 including the MPU 1701 which executes various control procedures of the printing apparatus 1. The NVRAM 1708 can store history describing mounting/dismounting record of the four ink cartridges to/from the printhead 15 so that the printing apparatus can determine the four ink cartridges has been mounted/dismounted to/from the printhead 15.

The control circuit board 32 and printhead 15 are connected by a flexible cable (not shown) via the carriage 11 to which the printhead 15 is mounted. A memory element 30 can also be arranged as a non-volatile memory such as an EEPROM, FeRAM, or MRAM on the carriage 11. In a case where the printhead 15 is mountable to the cartridge 11, its mounting/dismounting information can be stored as the history in the memory element 30. In a case where the printhead 15 and carriage 11 are integrated with each other, either the memory element 18 of the printhead 15 or the memory element 30 of the carriage 11 can share the history.

As described above, this embodiment prepares a plurality of, e.g., four ink cartridges 2 which contain inks in accordance with the number of ink colors.

All the memory elements 18, 21, 30, and 31 arranged at respective portions of the printing apparatus are non-volatile memories, and hold stored data even upon powering off the printing apparatus main body.

In an initial stage when a user has just started using the printing apparatus, the areas of the memory elements 18, 21, 30, and 31 shown in FIG. 4 in which the mounting/dismounting history is stored are all "0"s, i.e., no history information is stored.

A case where the printing apparatus has been used and the ink cartridge or printhead need to be exchanged will be considered.

Figure 5:
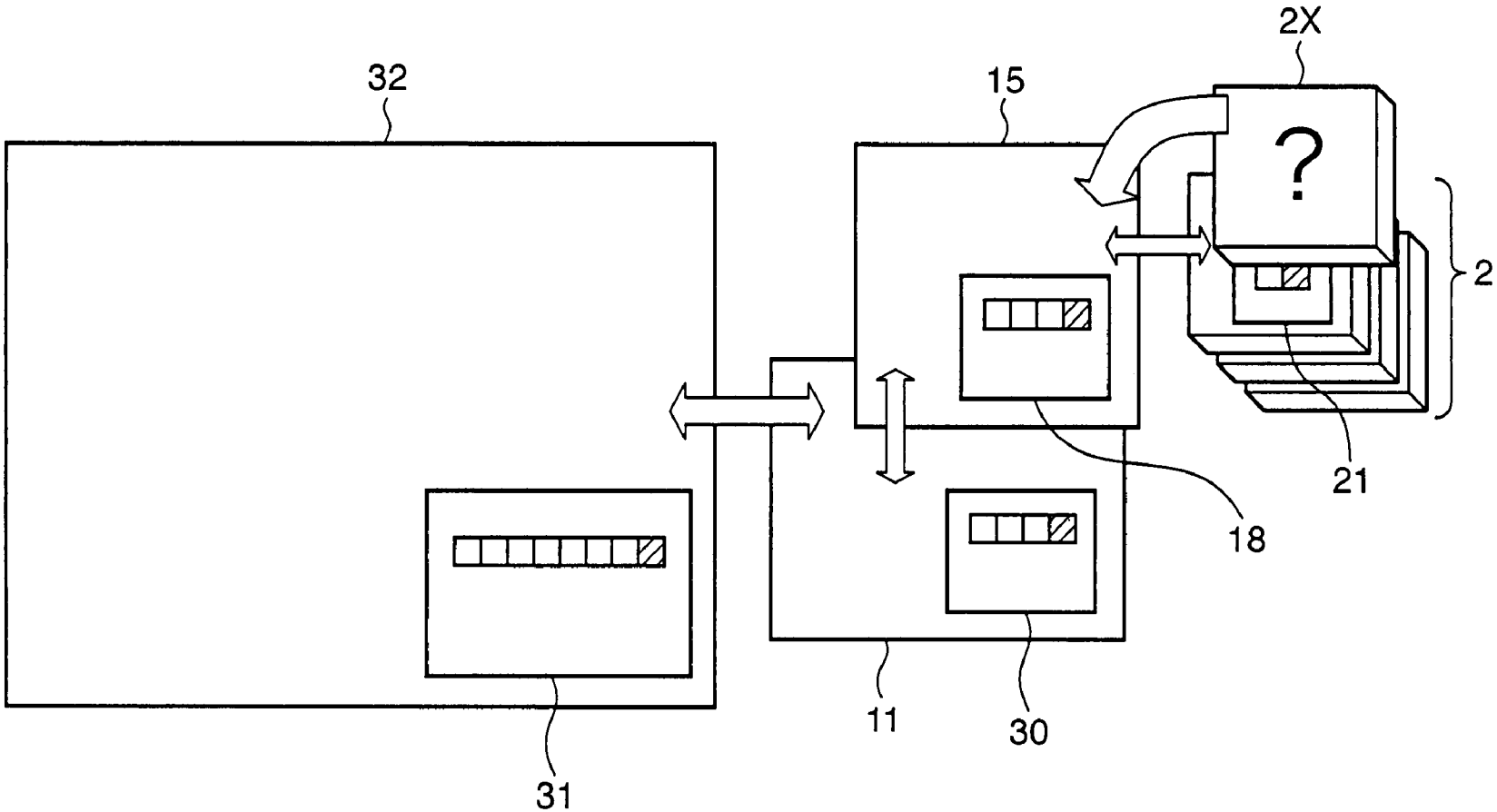
FIG. 5 is a functional block diagram showing the relationship between the printhead, the carriage, and the control circuit board when one of four ink cartridges is exchanged.

FIG. 5 is a functional block diagram showing the relationship between the printhead, the carriage, and the control circuit board when one of the four ink cartridges is exchanged.

When even one ink cartridge 2X which is different from normally used one or is of a different type is mounted among the ink cartridges 2, as shown in FIG. 5, no memory element is arranged at a proper position of the ink cartridge, or even if a memory element is arranged, the memory element is not normally connected to the contact 28, and no information on that type can be obtained. The fact that information on the type of mounted ink cartridge cannot be obtained is stored as the history in at least one of the memory elements 18, 30, and 31.

As a general information storage method, the following methods are available in accordance with the type of memory element used:

(1) "1" is set at a bit of the storage area (rewritable); and (2) a part of a circuit or wiring in the storage area is changed by disconnection or the like (unrewritable).

In a case where the memory element portion is built into the same board as the semiconductor integrated circuit board including functional elements together with the printing element of the printhead 15 that has been considered herein, the method (2) can be adopted to reduce the components of the memory element and the packaging cost. The area used to store the history is desirably weighted in accordance with the exchange frequency of consumables.

For example, the exchange frequency of the ink cartridge 2 is high, and thus the capacity of the memory element can be set smaller than that of the printhead 15. Also, memory elements manufactured by different processes can be arranged at appropriate portions. An EEPROM, an FeRAM, and a memory element of a type which disconnects part of a circuit or wiring can coexist. When selecting optimal memory elements, not only function and cost but also the features of the memory elements are considered, thereby providing a low-cost, high-reliability printing apparatus. In any case, a memory element having a function capable of storing the mounting/dismounting history can be utilized as an important building component of the printing apparatus, printhead, and ink cartridge to which the present invention is applied.

In this manner, abnormal mounting of the ink cartridge is detected upon mounting/dismounting, history information is stored in the memory element of a peripheral building component which normally functions, and it can be determined that the printing apparatus have abnormally been used even once.

In recover operation, the history information is read out from the memory element, and the control circuit board 32 can correctly determine where abnormality has occurred. If an erroneously mounted component (e.g., an ink cartridge or printhead) must be exchanged, the user is informed about which component has to be exchanged via a user interface such as the display of a host apparatus. If no host apparatus is used, the user can be notified of this via a display device (e.g., a small-size LCD) attached to the printing apparatus. In this notification, the user can also be notified of detailed information on the basis of component identification information obtained together with the history information.

Particularly when an ink cartridge different from one used normally is mounted, the ink outlet port in the bottom of the ink cartridge and the printhead cannot be properly coupled at the joint, and ink may leak from the ink cartridge. It is, therefore, an important function of increasing the reliability of the printing apparatus to predict ink leakage in the printing apparatus or degradation of the printhead function caused by chemical reaction between inks different in composition.

More specifically, these errors are dealt with by controlling to shorten the interval of printhead recovery operation in comparison with a normal state or prolong the preliminary discharge time, or in some cases, displaying a message which prompts the user to take a proper remedy. It is also possible to prevent in advance a large amount of ink having a different composition from entering the printhead by checking identification information of a mounted ink cartridge or the like in the printing apparatus before the start of printing operation. This can also be implemented by determining that an ink cartridge different from a predetermined one has been mounted when no identification information is acquired from the mounted ink cartridge.

In addition, ink having a different composition may enter near the joint between the ink cartridge and the printhead upon only simple mounting/dismounting. Such a different type of ink can be replaced earlier by executing long-time recover operation as far as the amount of entered ink is small.

Figure 6:
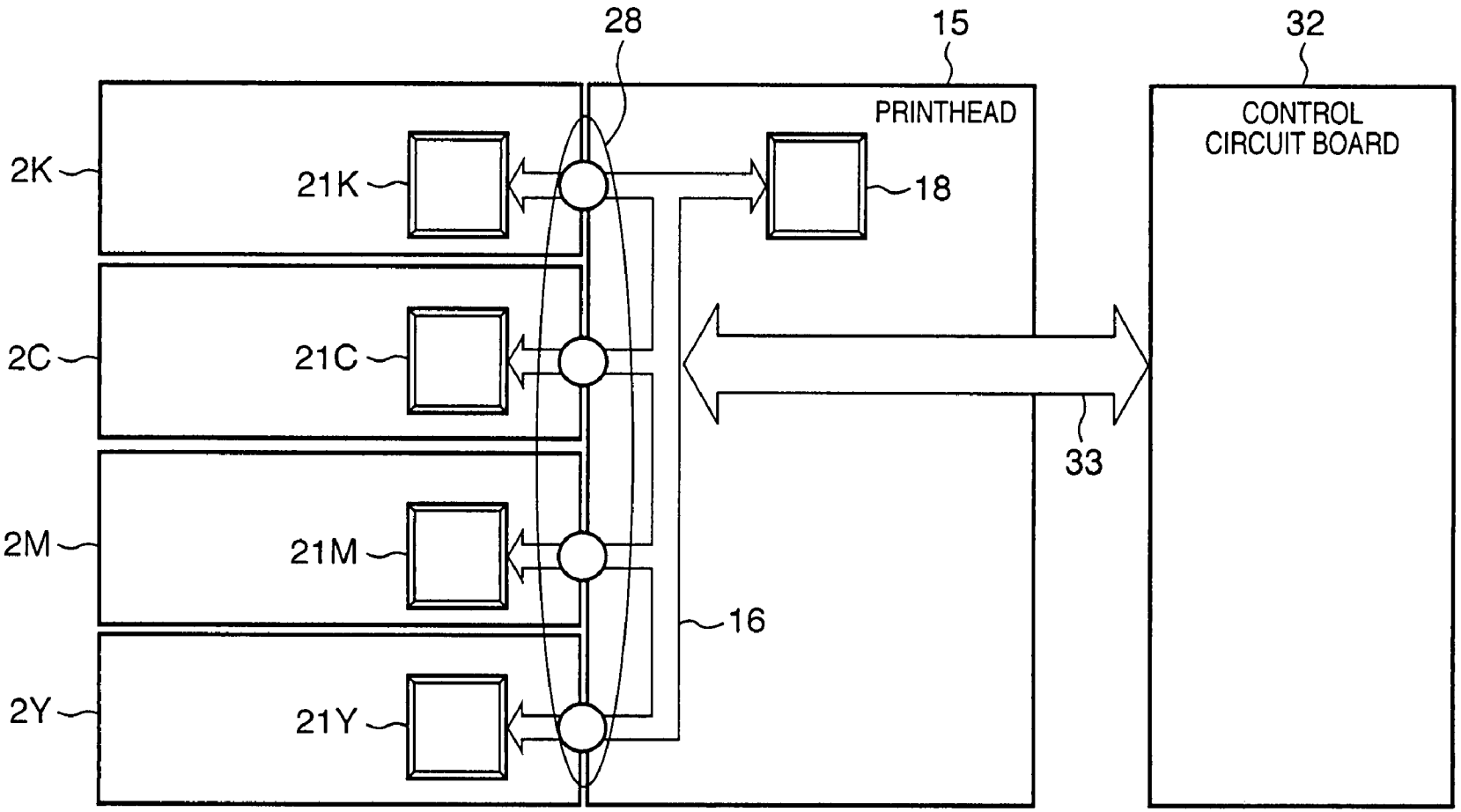
FIG. 6 is a schematic view showing the electrical connections between the printhead, the four ink cartridges, and the control circuit board.

FIG. 6 is a schematic view showing the electrical connections between the printhead 15, the four ink cartridges, and the control circuit board.

In FIG. 6, the ink cartridges 2K, 2C, 2M, and 2Y which respectively store black ink, cyan ink, magenta ink, and yellow ink are mounted in the printhead 15. Memory elements 21K, 21C, 21M, and 21Y attached to the respective ink cartridges are electrically connected to the printhead 15 via the contact 28. Information from each memory element can be transmitted to the memory element 18 of the printhead 15 via a signal transmission line 16, and can also be transmitted to the control circuit board 32. Note that the memory elements 21K, 21C, 21M, and 21Y are generally referred to as the memory elements 21, unless otherwise specified.

The memory element 21 stores identification information of the ink cartridge 2, consumption information of ink, and the like. The signal transmission line 16 is laid out in the board of the printhead 15, and serves as a means for accessing the memory element 21 arranged on the ink cartridge 2 in addition to the memory element 18 of the printhead 15 integrated on the same board. The signal transmission line 16 laid out in the board of the printhead 15 and the control circuit board 32 transmit memory information via a flexible cable 33 connected to the carriage 11. Identification information is used by the MPU 1701 integrated in the control circuit board 32, and the MPU 1701 determines on the basis of the information whether or not the mounted ink cartridge is normally used one.

The memory element 18 of the printhead 15 may store the ink cartridge mounting history together with the result of determining the type of mounted ink cartridge. In a case where an ink cartridge having a memory element which stores information representing that ink is different from one used from the beginning (meaning that identification information is different), an ink cartridge having no history of an ink used from the beginning, or an ink cartridge having no memory element 21 is mounted, information representing that the ink cartridge different from normally used one has been mounted may be transmitted to the MPU 1701, and stored as the ink cartridge mounting history in the memory element 18.

Figure 7:
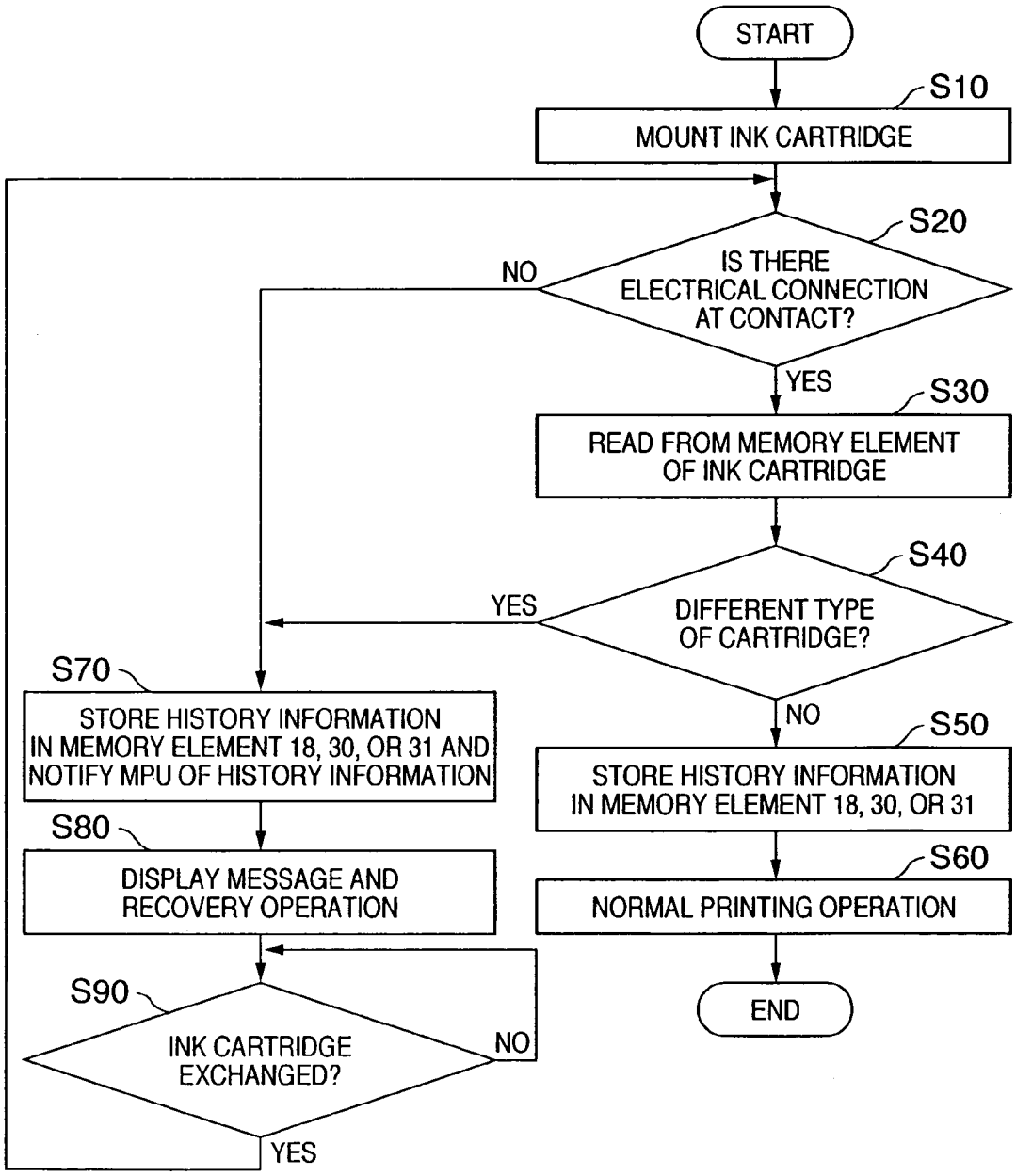
FIG. 7 is a flowchart showing a process of discriminating a different type of ink cartridge.

The above-described processes are summarized into the flowchart shown in FIG. 7.

In step S10, the user mounts an ink cartridge. In step S20, it is determined whether or not an electrical connection has been established at the contact 28 by mounting. If no electrical connection is established, it is determined that the mounted ink cartridge is of a type different from normally used one, and the process advances to step S70. If the electrical connection is established, the process advances to step S30 to read identification information of the ink cartridge from the memory element 21 of the mounted ink cartridge. In step S40, it is determined on the basis of the read information whether or not the mounted ink cartridge is a certified ink cartridge suitable to the printing apparatus.

If it is determined that the ink cartridge is a certified one, the process advances to step S50 to store the mounting history information in at least one of the memory elements 18, 30, and 31. After that, the process advances to step S60 to move to a normal printing operation, and the process of discriminating a different type of ink cartridge ends.

On the other hand, if it is determined that the ink cartridge is of a different type, the process advances to step S70 to store the mounting history information in at least one of the memory elements 18, 30, and 31 and notify the MPU 1701 of the determination result. The process advances to step S80 to display a message and prompt the user to an appropriate operation such as an exchange of an ink cartridge. Moreover, a process of performing recovery operation and discharging a different type of ink from the printhead is executed. In step S90, the process waits for an exchange of an ink cartridge. When the ink cartridge is exchanged, the process returns to step S20 to repeat the above process.

According to the above-described embodiment, even if a different type of ink cartridge is mounted, the type of mounted ink cartridge can be properly determined, and a different type of ink is prevented from entering the printhead when the different type of ink cartridge is mounted, or the different type of ink is quickly discharged. Therefore, the printhead can be maintained in good printing conditions.

Note that the control operations described above can be applied to printheads having various arrangements regardless of the difference in wiring specific to the printhead.

As many apparently widely different embodiments of the present invention can be made without departing from the spirit and scope thereof, it is to be understood that the invention is not limited to the specific embodiments thereof except as defined in the appended claims:

CLAIM OF PRIORITY

This application claims priority from Japanese Patent Application No. 2004-106352 filed on Mar. 31, 2004, the entire contents of which are incorporated herein by reference.

What is claimed is:

1. A printing apparatus which prints on a printing medium by using an inkjet printhead, used to discharge ink supplied from a cartridge that contains ink and has a first non-volatile memory storing identification information of the cartridge, comprising an electric contact for establishing an electrical connection with the first non-volatile memory in order to read the identification information from the first non-volatile memory when the cartridge is connected, comprising:

detection means for detecting mounting of the cartridge;

discrimination means for discriminating, on the basis of the identification information read from the first non-volatile memory of the cartridge, whether or not the mounted cartridge is a certified one for the printing apparatus; and control means for performing printing operation by the ink let printhead, wherein said control means is mounted on a control circuit board, wherein the control circuit board has a second non-volatile memory which stores information, and wherein exchange history information of the cartridge is stored in the second non-volatile memory.

* * * * *

UNITED STATES PATENT AND TRADEMARK OFFICE

CERTIFICATE OF CORRECTION

PATENT NO. : 7,314,263 B2
APPLICATION NO. : 11/094164
DATED : January 1, 2008
INVENTOR(S) : Kimiyuki Hayasaki et al.

It is certified that error appears in the above-identified patent and that said Letters Patent is hereby corrected as shown below:

COLUMN 6

Line 16, “layer 27” should read --lever 27--.

COLUMN 7

Line 36, “cartridge 11” should read --carriage 11--.

COLUMN 10

Line 58, “ink let” should read --ink jet--.

Signed and Sealed this

Fifth Day of August, 2008

JON W. DUDAS
*Director of the United States Patent and Trademark Office*